US007060650B2

(12) United States Patent
Rendina

(10) Patent No.: US 7,060,650 B2
(45) Date of Patent: Jun. 13, 2006

(54) HYDROGENATION CATALYSTS AND METHODS

(76) Inventor: David D. Rendina, 967 Heritage Blvd., North Vancouver, British Columbia, V7J 3G6 (CA)

( * ) Notice: Subject to any disclaimer, the term of this patent is extended or adjusted under 35 U.S.C. 154(b) by 0 days.

(21) Appl. No.: 11/235,152

(22) Filed: Sep. 27, 2005

(65) Prior Publication Data

US 2006/0019823 A1 Jan. 26, 2006

Related U.S. Application Data

(63) Continuation-in-part of application No. 10/357,628, filed on Feb. 4, 2003, now abandoned.

(60) Provisional application No. 60/354,185, filed on Feb. 4, 2002.

(51) Int. Cl.
*B01J 27/047* (2006.01)

(52) U.S. Cl. ..... 502/216; 502/219; 502/220; 502/344; 502/340

(58) Field of Classification Search ..... 502/216, 502/219, 220, 344, 340
See application file for complete search history.

(56) References Cited

U.S. PATENT DOCUMENTS

| | | | | |
|---|---|---|---|---|
| 3,933,688 | A * | 1/1976 | Dines | 252/519.4 |
| 4,040,917 | A * | 8/1977 | Whittingham | 205/494 |
| 4,822,590 | A * | 4/1989 | Morrison et al. | 423/561.1 |
| 4,853,359 | A * | 8/1989 | Morrison et al. | 502/220 |
| 5,783,065 | A * | 7/1998 | Wiser et al. | 208/400 |

* cited by examiner

*Primary Examiner*—Elizabeth D. Wood

(57) ABSTRACT

Catalysts and composite materials comprised of catalytically active materials intercalated with alkali metals and/or optionally coated on alkali metals or combinations of alkali and alkali earth metals are disclosed. Also disclosed are methods for enhancing reactions between hydrogen and organic materials by reacting said catalysts with solvents where such reactions generate a portion of the hydrogen and heat necessary to cause the desired reaction between an organic material and hydrogen and also act to fracture said catalytically active material into higher surface area particles with enhanced catalytic ability. Said catalysts may be dispersed in immiscible aprotic solvents to enhance transportation and safety considerations prior to use.

31 Claims, No Drawings

HYDROGENATION CATALYSTS AND METHODS

CROSS REFERENCE TO RELATED APPLICATION

This application is a Continuation-in-Part of U.S. patent application Ser. No. 10/357,628 filed Feb. 4, 2003 and now abandoned which claims priority from U.S. Provisional Patent Application No. 60/354,185 filed Feb. 4, 2002 entitled Materials, Methods and Systems Useful in the Upgrading of Hydrocarbons and Reduced Production of GHG.

FIELD OF THE INVENTION

The present invention relates to catalysts, composite materials, and new methods useful in the hydrogenation of organic materials.

BACKGROUND OF THE INVENTION

New catalysts and new processes that enhance reactions between hydrogen and organic materials will be of great benefit to many industries. One industry that clearly exemplifies some of those benefits is the energy industry. The expanding need for energy in North America, combined with the depletion of known crude oil reserves, has created a serious need for the development of alternatives to crude oil as an energy source. One of the most abundant energy sources, particularly in the United States, is coal. Estimates have been made which indicate that the United States has enough coal to satisfy its energy needs for the next two hundred years, while Canada has over 330 billion barrels of oil bound in the bitumen tar sands of Alberta.

Unfortunately both coal and tar sands (bitumen) are solids, or nearly solids, at ambient temperatures. They have a high carbon content but hydrogen contents of typically only 5% to 9%. In comparison with fuels that are liquid at ambient temperatures, they are inconvenient to handle and unsuited to some applications. Most notably they cannot be used directly to fuel the internal combustion engines and turbines that dominate transportation infrastructures worldwide. Transportation fuels are derived overwhelmingly from crude oil, which has about twice the hydrogen content of coal. The hydrogen content of typical transportation fuels varies from approximately 12.5% in some gasolines to approximately 14.5% in aviation turbine fuels. For coal or bitumen to replace them, they must be converted to liquids with similar hydrogen content.

Liquid fuels have long been produced from coal and bitumen. In general, current processes achieve this by either removing carbon (through pyrolysis or coking) or adding hydrogen (through liquefaction or hydrogenation). Since a comparison of the relative costs of crude oil and these other hydrocarbons are favorable, the commercial viability of such hydrocarbons as transportation fuels depends on the overall economics of the conversion processes. Recent estimates (1990) indicate that two-stage conversion of coal to liquids has a product cost of about $38 per barrel and that the improved quality of the liquids makes them equivalent to oil costing $33 per barrel. Environmental costs are also high. Converting coal to transportation fuels reportedly results in 7–10 times as much $CO_2$ emissions as converting crude oil. This increase in $CO_2$ emissions at the processing stage has the effect of raising overall $CO_2$ emissions from the transportation sector by approximately 50%, compared with transport based on conventional, refined petroleum products.

Incremental improvements to the established process steps are unlikely to decrease processing costs sufficiently to achieve a competitive price of $25 per barrel or to significantly reduce $CO_2$ emissions.

Structurally, bituminous coal typically consists of monocyclic and condensed aromatic rings, varying in size from a single ring to perhaps four or five rings, linked to each other by connecting bridges which are typically short aliphatic chains or etheric linkages. Generally, coal liquefaction and bitumen hydrogenation processes occur at temperatures exceeding 400° C. by rupturing the connecting bridges to form free radicals. The free radicals are then capped by a small entity such as hydrogen. If the free radicals are not capped, they will combine in condensation or polymerization reactions to produce large structures that are solid at room temperature.

The direct coal liquefaction technologies produce large amounts of hydrocarbon gases, the ratio of liquids to hydrocarbon gasses usually being of the order of 3/1 to 4/1. Residence times of materials (reactants plus products) in the temperature zone above 350° C. are characteristically between 15 minutes and 1 hour. Such long exposure of the primary liquid molecules to temperatures above 350° C. results in extensive thermal cracking, yielding hydrocarbon gasses. Since more than half of the gas formed is methane, this cracking results in a large consumption of hydrogen and significantly increases the cost of production.

Recent studies described by Wiser et al, in U.S. Pat. No. 5,783,065 have reportedly demonstrated an improved simultaneous process for direct liquefaction and hydrogenation in the presence of a catalyst that generates a high proportion of liquid hydrocarbon product. Part of the benefit taught by the Wiser process is claimed to be the shortening of reaction times, thereby limiting hydrocracking and thus producing a higher quantity of liquid product.

It would be beneficial if catalytic hydrogenation of organic materials could be accomplished under conditions where the organic materials were not exposed to temperatures in excess to those required for the desired reaction for excess periods of time.

Whatever the organic feedstock, it can be generally stated that the efficiency of the hydrogenation process is enhanced by employing materials and methods whereby the molecules of feedstock are brought together with hydrogen, under temperature and pressure conditions required to cause the substances to react in the presence of a fresh catalytically active surface. In other words the heat, hydrogen, and organic material must all come together at the same time on the surface of the catalyst. Processes that enhance the probability of these conditions occurring simultaneously would be generally anticipated to improve efficiency. The present inventor has discovered that these and other benefits may be realized by the application of a catalyst comprised of intercalation compounds on a support structure.

Intercalation compounds may be conceptualized as being comprised of two components, a host intercalated material (M), and a visiting insertion material or intercalate (X). The host intercalation materials may be defined as elements, naturally occurring intermetallic compounds, or synthetic structures that allow the reversible insertion of ions, atoms, or molecules of another material (i.e. the intercalate) within spaces in the host structure. The bonding of the intercalated material with the intercalate does not change the chemical properties of the intercalate. In other words lithium intercalated into a material remains essentially lithium—hydrogen intercalated within a host remains essentially hydrogen and each can typically be repeatedly withdrawn and reinserted without damage to the host. It is often desirable that the host material is dimensionally stable during repeated intercalations and de-intercalations.

Alkali metal intercalated compounds are well known commercially produced materials. They are particularly well recognized with respect to their use as both anode and cathode materials in lithium batteries. Processes for intercalating alkali metals do not form a part of the present invention and any known methods for intercalation may be employed. Intercalation methods may be exemplified by U.S. Pat. No. 3,933,688, to Dines and U.S. Pat. No. 4,040,917 to Whittingham, and many other examples known to those skilled in the art.

U.S. Pat. No. 4,822,590 and U.S. Pat. No. 5,072,886, to Morrison et al., both of which are incorporated in the present application by reference, discloses how layered or porous materials intercalated with alkali metals may be separated or fractured into higher surface area materials by immersing the alkali metal intercalated material in a liquid that generates a gas upon reaction with the alkali metal. It is suggested that the separated or fractured materials may be useful in catalysis. However, the patents do not teach the benefit that may be achieved by employing the heat and hydrogen and fresh catalytically active surfaces generated by said reaction to enhance the hydrogenation of organic material.

SUMMARY OF THE INVENTION

A composite of the form MXY is disclosed where MX is a catalyst and Y is a particle or support structure. A catalyst of the form MX is disclosed where M is an intercalation host and X is an alkali metal intercalated within the host. It is preferred that M is a chalcogenide and X is lithium. It is more preferred that M is a transition metal dichalcogenide and most preferred that M is $MoS_2$ or $WS_2$.

The catalyst may be coated onto the surface of a particle or support structure to produce a composite of the form MXY where Y is a material selected from the Group IA-alkali metals, alkali metal hydrides, Group IIA-alkali earth metals, alkali earth metal hydrides. Group IIIA-metals, metal hydrides, and alloys, combinations, or mixtures of the said Group IA. IIA and IIIA materials. It is preferred that the alkali metals are comprised of sodium and potassium , and their hydrides, and the alkali earth metals are comprised of calcium and magnesium and their hydrides, and the metals are comprised of aluminum and aluminum hydride. Y may also be a compound or mixture of the Group IA, Group IIA and/or Group IIA materials. It is most preferred that Y is sodium. It is further preferred that Y have dimensions between 1 and 100 microns.

The composite may be dispersed in a liquid material selected on the basis of its ability to protect the catalyst and/or composite from unintentional reactions prior to use, and on the basis of the compatibility of the liquid material with the organic material to be hydrogenated. In reactions involving the liquefaction of coal or the hydrogenation of bitumen, it is preferred that the organic liquid dispersant be a liquid hydrocarbon. It is most preferred that the liquid be a mixture of hexane and pentane.

The present inventor has discovered that the exfoliation or fracturing of these alkali metal intercalation catalysts by reaction with liquids that generate hydrogen gas while the catalysts are immersed in liquids or slurries comprised of organic material, will hydrogenate the organic material under relatively mild conditions.

According to the methods of this invention, there is provided a process for hydrogenating organic materials that comprises mixing the organic material to be hydrogenated with water and a catalyst of the form MX, or a composition of the form MXY, in a manner such that the water reacts with the X component of the catalyst, or alternatively the XY components of the composite, to produce both heat and hydrogen while simultaneously fracturing the M component of the catalyst or composite, thereby exposing catalytically active sites on the M component to enhance the hydrogenation of the organic material.

While not wishing to be limited in scope, the following experiments are supplied to illustrate aspects of the process disclosed.

EXPERIMENT 1

A 500 ml sample of bitumen, supplied from the Cold Lake region of Canada, was placed in a 1 liter metal reactor under argon atmosphere. A sample of a catalyst of the form MX comprised of 10 grams of lithium intercalated $MoS_2$ dispersed in 50 ml of hexane was mechanically mixed into the bitumen and reactions began immediately. The remaining volume of the container was filled with water under pressure while shaking and the container was sealed. The container was mechanically shaken for approximately a ½ hour. Overall temperatures within the reactor never exceeded 100° C., although it is assumed that spot temperatures at reaction sites may have been significantly higher. The resulting product was tested for asphaltene content by standard methods and it was determined that an approximate 22% reduction in asphaltene content had been achieved.

EXPERIMENT 2

Samples were prepared in a manner identical to those described in experiment 1 with the exception that a composite of the form MXY, comprised of 2 grams of lithium intercalated $MoS_2$ coated onto the surface of 10 grams of sodium metal particles, having an average particle size of 10 micron, dispersed in a 50 ml mixture of hexane and transformer oil replaced the MX catalysts described in experiment 1. A mixture having a dispersion of particles of sodium in transformer oil was supplied by Powertech Labs of Surrey British Columbia. The resulting product was tested for asphaltene content by standard methods and it was determined that a ~30% reduction in asphaltene content had been achieved.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A composite of the form MXY wherein

M is an intercalation host;

X is an intercalate alkali metal; and where Y is chosen from the group consisting of: sodium, potassium, hydrides of sodium, hydride of potassium, and alloys, combinations, or mixtures of said sodium, potassium, hydride of sodium, hydride of potassium, and wherein X and Y are not the same.

2. The composite of claim 1 where M is a chalcogenide.

3. The composite of claim 1 where M is a transition metal dichalcogenide.

4. The composite of claim 1 where M is $MoS_2$ or $WS_2$.

5. The composite of claim 1 wherein Y are particles in the range of 1 to 100 microns.

6. A dispersion of the composite of claim 1 in a liquid hydrocarbon.

7. A composite of the form MXY wherein

M is an intercalation host;

X is an intercalate alkali metal; and Y is chosen from the group consisting of: calcium, magnesium or hydrides of calcium or magnesium, and alloys, combinations, or mixtures of said calcium, magnesium or hydrides of calcium or hydrides of magnesium.

8. A composite of the form MXY wherein

M is an intercalation host;

X is an intercalate alkali metal; and Y is chosen from the group consisting of: aluminum or aluminum hydride, and alloys, combinations, or mixtures of said aluminum or aluminum hydride.

9. A composite of the form MXY wherein

M is an intercalation host;

X is an intercalate alkali metal; and Y is a material selected from the group consisting of: Group IA alkali metals and alkali metal hydrides, Group IIA alkali earth metals, alkali earth metal hydrides, Group IIIA metals and metal hydrides, and alloys, combinations, or mixtures of said Group IA alkali metals and alkali metal hydrides, Group IIA alkali earth metals, alkali earth metal hydrides Group IIIA metals and metal hydrides, wherein the composite is a catalyst and Y are particles coated with MX.

10. The composite of claim 9 where M is a chalcogenide.

11. The composite of claim 9 where M is a transition metal dichalcogenide.

12. The composite of claim 9 where M is $MoS_2$ or $WS_2$.

13. The composite of claim 9 where X is lithium.

14. The composite of claim 9 where Y is chosen from the group consisting of: sodium, potassium, or hydrides of sodium or potassium.

15. The composite of claim 9 where the size of particles of Y are in the range of 1 to 100 microns.

16. A dispersion of the composite of claim 9 in a liquid hydrocarbon.

17. The composite of claim 9 where Y is chosen from the group consisting of: calcium, magnesium or hydrides of calcium or magnesium.

18. The composite of claim 9 where Y is aluminum or aluminum hydride.

19. The composite of claim 7 where M is a chalcogenide.

20. The composite of claim 7 where M is a transition metal dichalcogenide.

21. The composite of claim 7 where M is $MoS_2$ or $WS_2$.

22. The composite of claim 7 where X is lithium.

23. The composite of claim 8 where M is a chalcogenide.

24. The composite of claim 8 where M is a transition metal dichalcogenide.

25. The composite of claim 8 where M is $MoS_2$ or $WS_2$.

26. The composite of claim 8 where X is lithium.

27. The composite of claim 7 wherein Y are particles in the range of 1 to 100 microns.

28. A dispersion of the composite of claim 7 in a liquid hydrocarbon.

29. The composite of claim 8 wherein Y are particles in the range of 1 to 100 microns.

30. A dispersion of the composite of claim 8 in a liquid hydrocarbon.

31. A composite of the form MXY wherein

M is an intercalation host;

X is an intercalate alkali metal; and where Y is chosen from the group consisting of: sodium, potassium, hydride of sodium, hydride of potassium, and alloys, combinations, or mixtures of said sodium, potassium, hydride of sodium, hydride of potassium, and wherein X is lithium.

* * * * *